US011092174B2

(12) United States Patent
Sassi et al.

(10) Patent No.: US 11,092,174 B2
(45) Date of Patent: Aug. 17, 2021

(54) PISTONE FOR HYDRAULIC MACHINES WITH AXIAL PISTONS

(71) Applicant: Dana Motion Systems Italia S. R. L., Reggio Emilia (IT)

(72) Inventors: Alessandro Sassi, Reggio Emilia (IT); Fabio Natali, Modena (IT); Federica Franzoni, Reggio Emilia (IT); Marco Candura, Modena (IT)

(73) Assignee: Dana Motion Systems Italia S.R.L., Reggio Emilia (IT)

( * ) Notice: Subject to any disclaimer, the term of this patent is extended or adjusted under 35 U.S.C. 154(b) by 0 days.

(21) Appl. No.: 16/781,959

(22) Filed: Feb. 4, 2020

(65) Prior Publication Data

US 2020/0248726 A1 Aug. 6, 2020

(30) Foreign Application Priority Data

Feb. 5, 2019 (IT) ..... 102019000001613

(51) Int. Cl.
*F15B 15/14* (2006.01)

(52) U.S. Cl.
CPC ..... *F15B 15/1447* (2013.01); *F15B 15/1457* (2013.01)

(58) Field of Classification Search
CPC .. F15B 15/1447; F15B 15/1457; F04B 1/124; F04B 53/14; F01B 3/0085; F03C 1/0605
See application file for complete search history.

(56) References Cited

U.S. PATENT DOCUMENTS

| | | | |
|---|---|---|---|
| 3,216,333 A | 11/1965 | Thoma | |
| 6,406,271 B1 | 6/2002 | Valentin | |
| 2007/0251377 A1 | 11/2007 | Ploog | |
| 2012/0210867 A1 | 8/2012 | Rateick et al. | |

FOREIGN PATENT DOCUMENTS

| | | | | |
|---|---|---|---|---|
| DE | 1169751 B * | 5/1964 | ..... | F16H 39/00 |
| EP | 0967520 A1 | 12/1999 | | |
| WO | 2016201241 A1 | 12/2016 | | |

* cited by examiner

*Primary Examiner* — Abiy Teka
(74) *Attorney, Agent, or Firm* — McCoy Russell LLP

(57) ABSTRACT

The present invention relates to a piston for hydraulic machines with axial positions, comprising a head connected to a stem which is extended along a longitudinal axis and forms a bottom arranged at the opposite end with respect to said head. The piston is further provided with at least one intake duct passing within it and having a first and a second end, which are mutually opposite, open respectively at the head and at the bottom. The distinctive aspect of the invention is that the piston also comprises at least one distribution duct passing within it, which has a first and a second end, which are mutually opposite, the first end of which is in fluid communication with the intake duct and the second end of which is open at the head, the piston being provided monolithically.

16 Claims, 6 Drawing Sheets

PISTONE FOR HYDRAULIC MACHINES WITH AXIAL PISTONS

CROSS-REFERENCE TO RELATED APPLICATIONS

The present application claims priority to Italian Patent Application No. 102019000001613, entitled "PISTONE PER MACCHINE IDRUALICHE A PISTONI ASSIALI", and filed on Feb. 5, 2019. The entire contents of the above-listed application is hereby incorporated by reference for all purposes.

TECHNICAL FIELD

The present invention relates to a piston for hydraulic machines with axial pistons.

BACKGROUND AND SUMMARY

Hydraulic machines with axial pistons are known, which are provided with a pumping assembly comprising a cylinder block rotating around a working axis and provided with a plurality of seats in which respective pistons are slidingly housed associated with an input/output drive shaft as a function of the fact that the machine operates as a pump or a hydraulic motor, which are in communication with a hydraulic oil distribution plate.

Each piston extends along a longitudinal axis and has a head comprising a spherical cap destined to engage in a relative seat defined on a sliding block associated with the drive shaft or obtained directly thereon, which is connected by means of an intermediate shank with a stem ending with a bottom arranged at the end opposite the head, which is housed inside the relative seat sliding on the cylinder assembly, in communication with the distribution plate.

Various types of piston are known, having different structures and obtained by means of different machining techniques. For example, pistons made in a single solid body or with cavities open towards the bottom of the piston are known, possibly filled with lightening inserts, which are obtained by means of conventional mechanical machining operations. Moreover, pistons formed by several parts obtained by conventional mechanical machining operations and connected to one another are known, for example by welding, to define closed internal lightening cavities.

Moreover, from the patent application No. WO2016/201241A1, pistons obtained by additive manufacturing are known, formed monolithically and provided with closed internal lightening cavities.

To reduce the friction and wear that arises from contact between the piston head and the relative seat, which are in relative motion with each other during the operation of the hydraulic machine, the respective surfaces must be lubricated.

For this purpose, the pistons of a known type are generally provided with an axial duct having the opposite ends open at the head and at the bottom, for the passage of hydraulic oil coming from the distribution plate towards the coupling area of the head with the relative seat.

At the outlet hole of the axial duct, the piston head generally has a flat region to define a flat annular portion around the hole, known as "well", which allows to create a hydraulic oil accumulation area between the piston head and the relative seat.

Moreover, to improve oil distribution in the entire coupling area between the piston head and the relative seat, a spiral-shaped channel can be provided, which extends from the well around the piston head, so as to promote lubrication of the entire contact area.

These pistons of a known type are not without drawbacks, including the fact that the need to provide the well and the spiral-shaped channel on the head considerably reduces the extension of the contact surface between the piston head and the relative seat, with a consequent increase in the specific contact pressures and, therefore, a greater risk of wear and/or damage to the components.

The main aim of the present invention is to eliminate the drawbacks of the known art listed above by devising a piston for hydraulic machines that allows, in use, an improvement of the hydrostatic support of the relative head in all angular conditions of operation and, therefore, for any displacement of the hydraulic machine.

Within the aim of this technical aim, another object of the present invention is that of increasing the contact surface between the piston head and the relative seat, so as to obtain a reduction in the specific contact pressures and in the consequent phenomena of wear.

Another aim of the present invention is that of being able to be produced in a single body, optionally with closed internal lightening cavities, by means of known machining techniques.

A further aim of the present invention is that of having a simple structure of relatively easy practical implementation, which is safe to use and operates effectively, and has a relatively limited cost.

This task and these aims are all achieved by the present piston for hydraulic machines with axial pistons comprising a head joined to a stem which is extended along a longitudinal axis and forms a bottom arranged at the end opposite to said head, at least one intake duct being further provided, which passes within said piston and has a first and a second end, which are mutually opposite and are open respectively at the head and at the bottom, characterized in that it comprises at least one distribution duct which passes within said piston, which has a first and a second end, which are mutually opposite, the first end of which is in fluid communication with said intake duct and the second end is open at said head, the piston being provided monolithically.

BRIEF DESCRIPTION OF THE DRAWINGS

Further characteristics and advantages of the present invention will be more apparent from the detailed description of two preferred, but not exclusive, embodiments of a piston for hydraulic machines with axial pistons, illustrated by way of non-limiting example in the accompanying drawings, wherein:

FIGS. 1-9 are drawn to scale, although other relative dimensions could be used.

DETAILED DESCRIPTION

Figure 1:
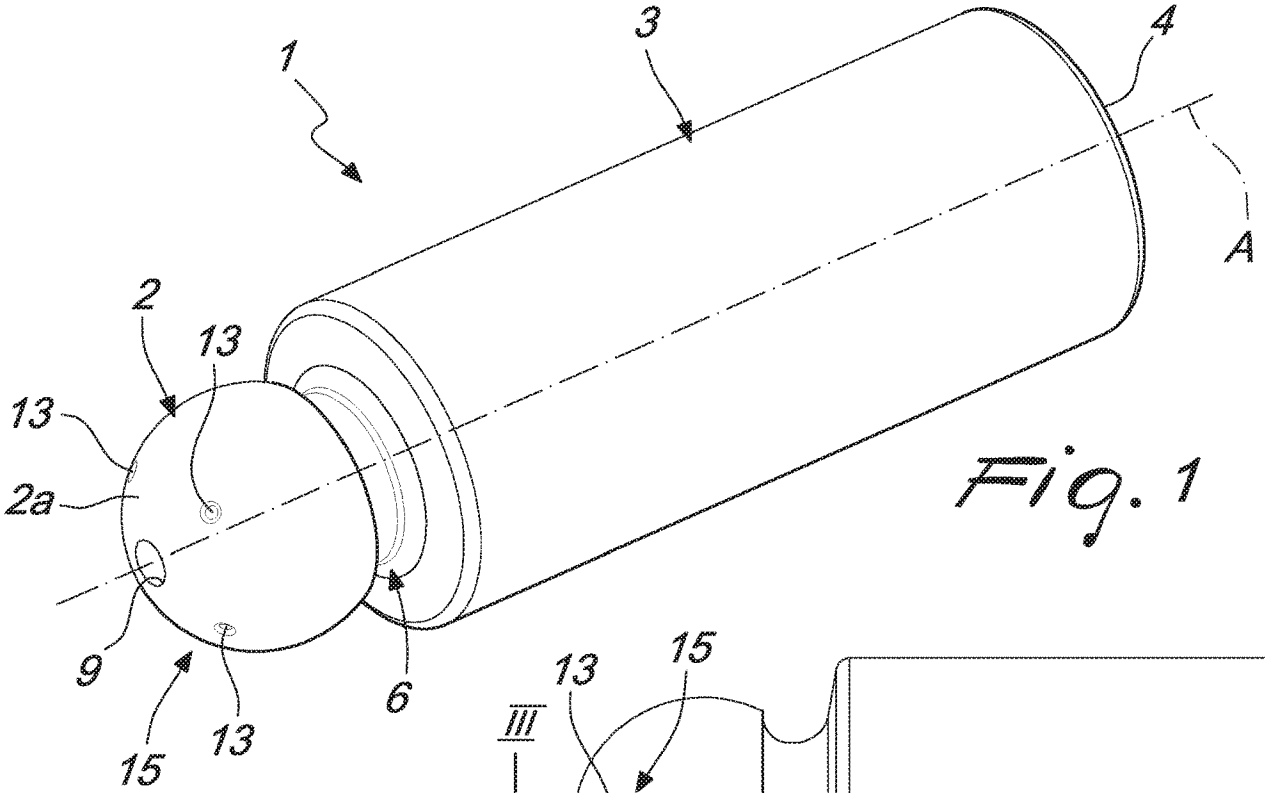
FIG. 1 is a schematic axonometric view of a first embodiment of a piston for hydraulic machines with axial pistons according to the invention.

With particular reference to these figures, the reference number 1 indicates as a whole a piston for hydraulic machines with axial pistons.

The piston 1 is destined to be incorporated in conventional hydraulic machines with axial pistons of the type with pumps and motors.

The piston 1 is particularly suitable for use in hydraulic machines with axial pistons of the bent-axis type, but can also be used for machines of the swash-plate type.

The piston 1 comprises a head 2 connected to a stem 3 which is extended along a longitudinal axis A and forms a bottom 4 arranged at the opposite end with respect to said head.

The head 2 is shaped to define, at least in the central portion with respect to the longitudinal axis A, a spherical cap 2*a* centred on the axis which defines the coupling area with the relative seat defined on the drive shaft or on a sliding block associated therewith.

The bottom 4 has a flat structure. On the lateral surface of the stem 3, in proximity of the bottom 4, annular seats 5 are provided for housing conventional sealing rings, not represented, designed to abut on the corresponding sliding seat of the piston 1 defined in the cylinder block of the hydraulic machine.

A connecting shank 6 is preferably interposed between the head 2 and the stem 3. The shank 6 generally has a narrower cross-section with respect to the head 2 and to the stem 3.

The piston 1 is provided with at least one intake duct 7 passing within it and having a first and a second end 8 and 9, which are mutually opposite, open respectively at the bottom 4 and at the head 2.

In use, hydraulic oil coming from the distribution plate of the hydraulic machine from the bottom 4 towards the head 2 of the piston 1 is fed through the intake duct 7 to lubricate the coupling area of the head in the relative seat defined on the drive shaft or on a sliding block associated therewith.

Preferably, the intake duct 7 has a rectilinear structure. Even more preferably, the intake duct 7 extends along the longitudinal axis A. In this case, the second end 9 of the intake duct 7 is arranged centrally with respect to the spherical cap 2*a* of the head 2.

At the second end 9 the intake duct 7 has an outwardly flared structure.

At the second end 9 of the intake duct 7, a flat annular region 10 can be provided on the head 2, which surrounds said second end to define, in use, a hydraulic oil accumulation well between the head 2 and the relative seat. The extension of this flat region 10 is in any case limited with respect to those provided on conventional pistons.

Along the intake duct 7 a portion with a segment having a reduced section can be provided, which has a constricting function to decouple the pressure of the hydraulic oil acting at the bottom 4 from the one acting at the head 2.

The piston 1 also comprises at least one distribution duct 11 passing within it, which has a first and a second end 12 and 13, which are mutually opposite, the first end 12 of which is in fluid communication with the intake duct 7 and the second end 13 of which is open at the head 2. More precisely, the second end 13 of the at least one distribution duct 11 flows into the spherical cap 2*a* of the head 2.

The presence of the at least one distribution duct 11 allows, in use, correct hydrostatic support of the head 2 of the piston 1 housed in the relative seat to be obtained, without involving important reductions in the extension of the contact surface.

Advantageously, the piston 1 is provided monolithically. For example, the piston 1 can be obtained monolithically by an additive manufacturing process of the 3D printing type.

The piston 1 can have at least one groove 14 which is formed on the outer surface of the head 2 which is in fluid communication with the second end 13 of the at least one distribution duct 11 to promote, in use, the distribution of hydraulic oil in the contact area between the head 2 and the relative seat.

Preferably, the groove 14 intercepts the second end 13 of the at least one distribution duct 11.

Even more preferably, the groove 14 has an annular extension around the longitudinal axis A, so as to promote, in use, the distribution of hydraulic oil on the whole of the periphery of the head 2 ensuring correct lubrication regardless of the inclination of the piston 1 with respect to the relative seat and, hence, of the displacement of the hydraulic machine.

In a preferred embodiment, the piston is provided with a plurality of distribution ducts 11 having the corresponding second ends 13 distributed at the head 2. More precisely, the second ends 13 of the distribution ducts 11 open at the spherical cap 2*a* of the head 2.

Preferably, at least one group 15 of distribution ducts 11 is provided, which have the respective second ends 13 distributed along a circumference centred on the longitudinal axis A.

A corresponding groove 14 can be provided at this circumference.

The second ends 13 of the distribution ducts 11 of the group 15 are distributed with constant angular pitch around the longitudinal axis (A).

Moreover, the respective first ends 12 of the distribution ducts 11 of the group 15 are directly in communication with the intake duct 7.

Alternatively, at least two groups 15 and 15' of distribution ducts 11 can be provided, which have the relative second ends 13 which are distributed along respective circumferences which are arranged so as to be offset along the longitudinal axis A. In this case, the second ends 13 of the distribution ducts 11 of the groups 15 and 15' are arranged so as to be angularly offset around the longitudinal axis A.

Moreover, the piston 1 can be provided with an annular collection notch 16 of hydraulic oil which is defined on the outer surface of the head 2. The second ends 13 of the distribution ducts 11 are positioned between the notch 16 and the second end 9 of the intake duct 7.

The notch 16 can be provided at the periphery of the spherical cap 2*a* of the head 2.

In use, part of the hydraulic oil that is delivered from the intake ducts 11 and is distributed on the head 2 is collected along the notch 16.

Moreover, the piston 1 can be provided with at least one internal lightening cavity defined at the head 2 and/or at the stem 3. Preferably, the cavity or cavities are distributed symmetrically around the longitudinal axis A.

It should be noted that for use in hydraulic machines with fixed displacement, when the displacement of the hydraulic machine in which the piston 1 is to be incorporated varies, the spatial distribution of the distribution ducts 11 and of the relative second ends 13 can be concentrated in given areas, as a function of the specific geometric operating configuration assumed by the piston 1 to optimize the hydrostatic support of the head 2 in the relative seat.

Instead, for machines with variable displacement, a uniform distribution of the distribution ducts 11 and of the corresponding second ends 13 allows an adequate hydrostatic support of the head 2 in the relative seat to be obtained when the geometric operating configuration assumed by the piston varies.

Figure 2:
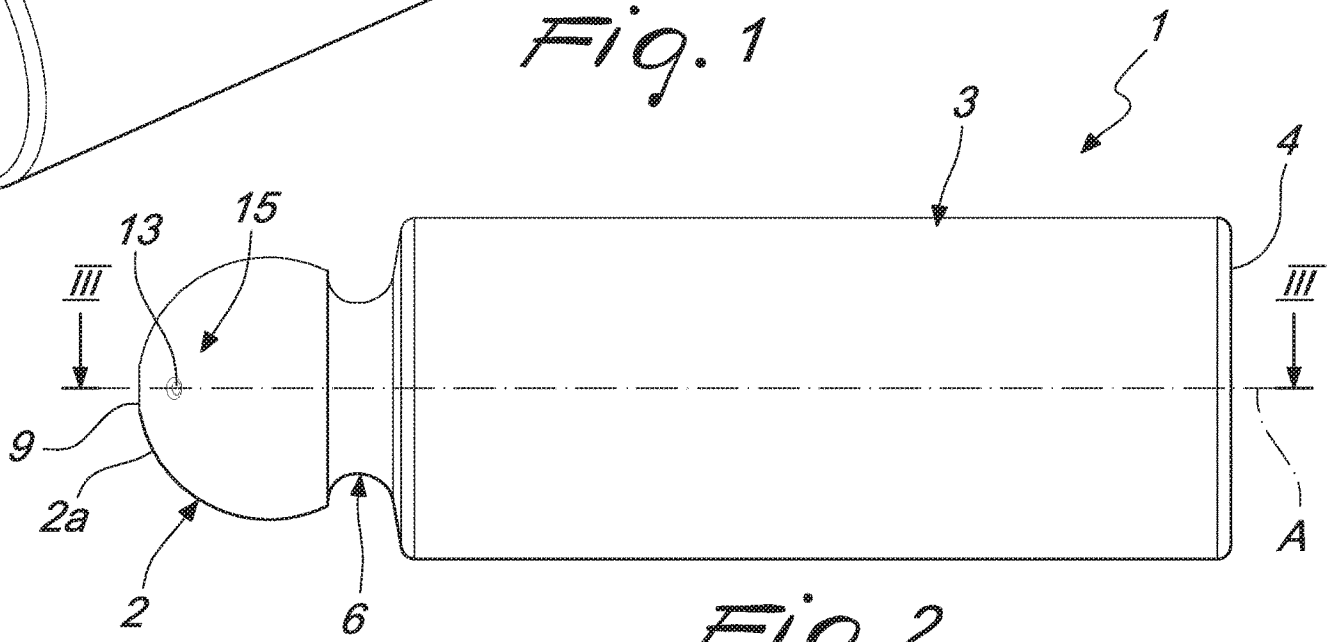
FIG. 2 is a schematic front elevation view of the piston of FIG. 1.
Figure 3:
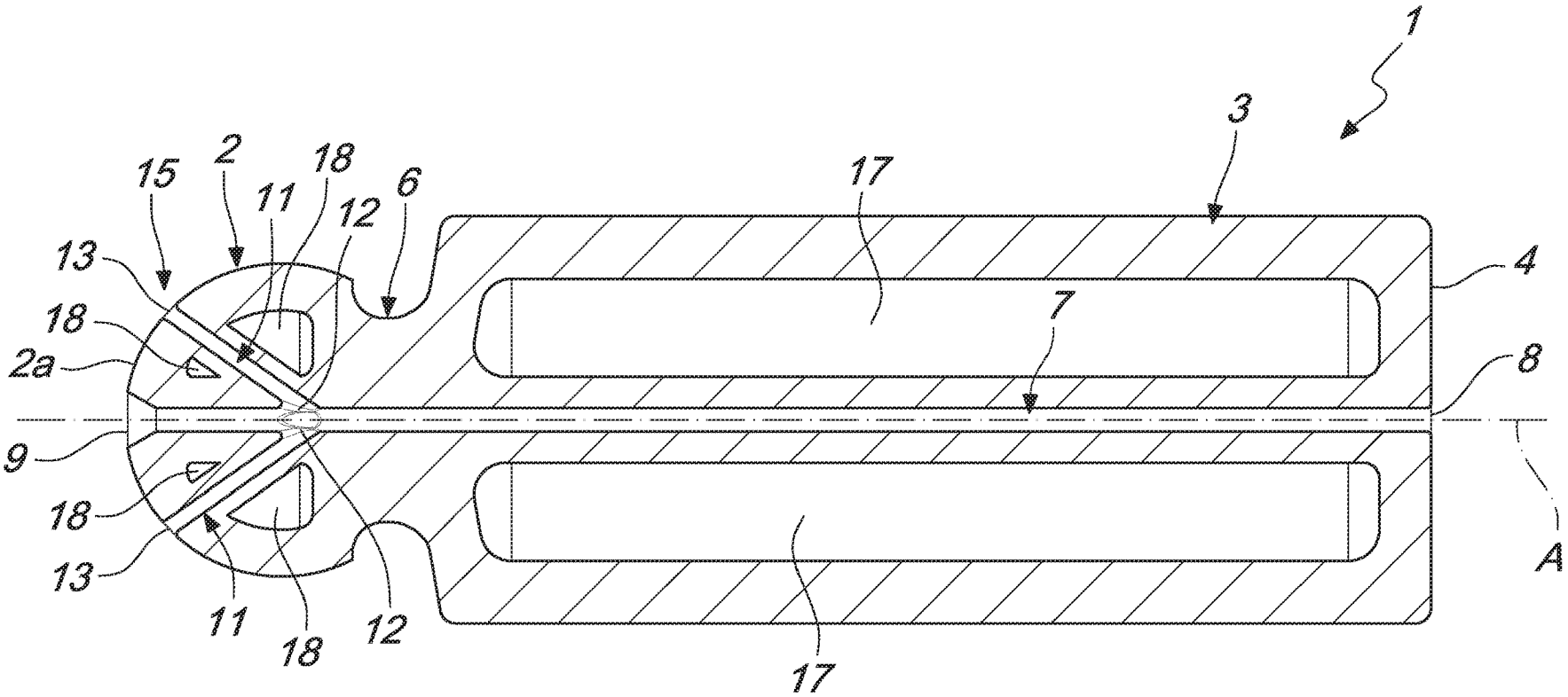
FIG. 3 is a schematic sectional view along the plane of FIG. 2.
Figures 4, 5:
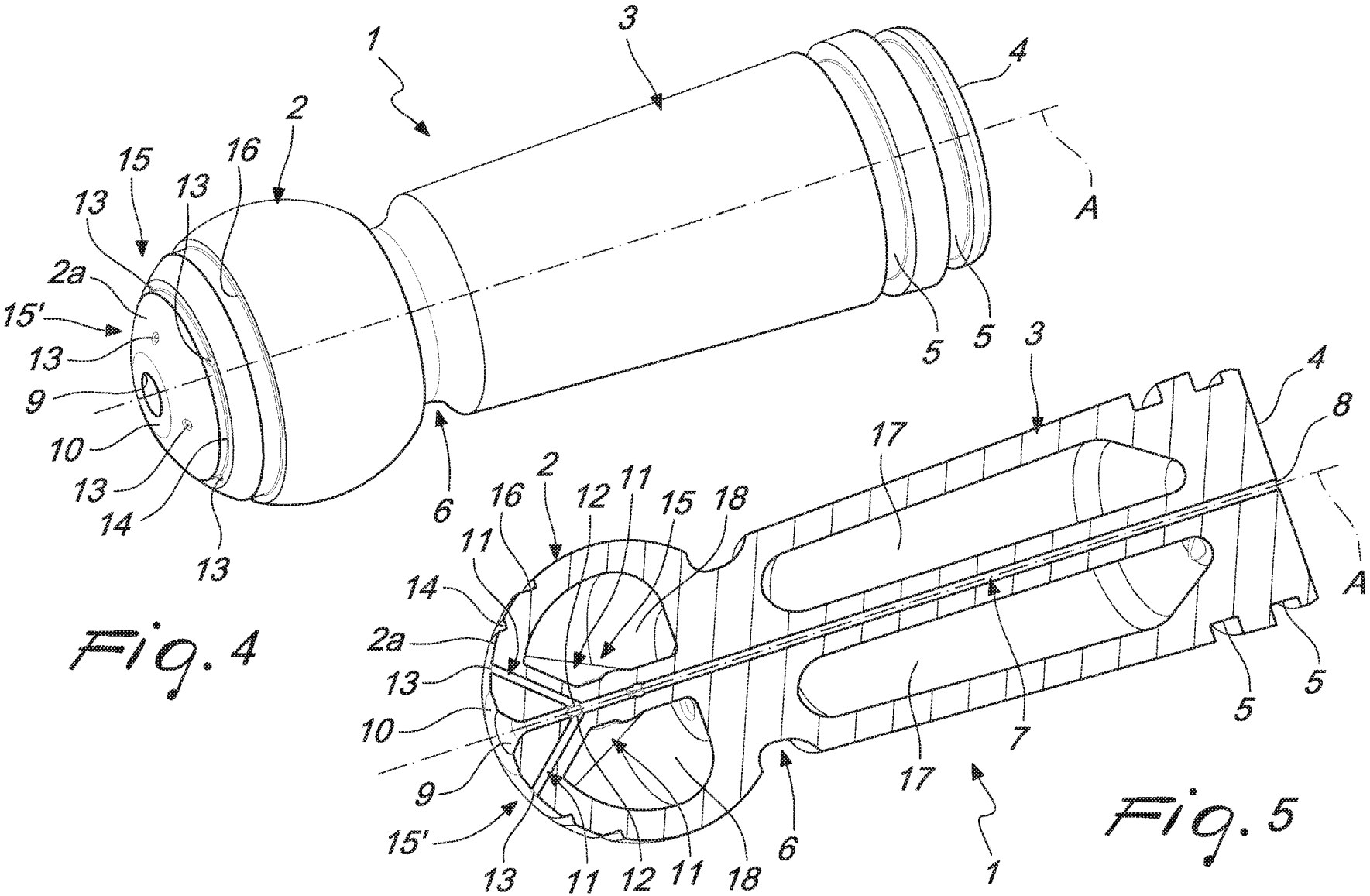
FIG. 4 is a schematic axonometric view of a second embodiment of the piston according to the invention.
FIG. 5 is a longitudinal sectional view of the piston of FIG. 4.
Figure 6:
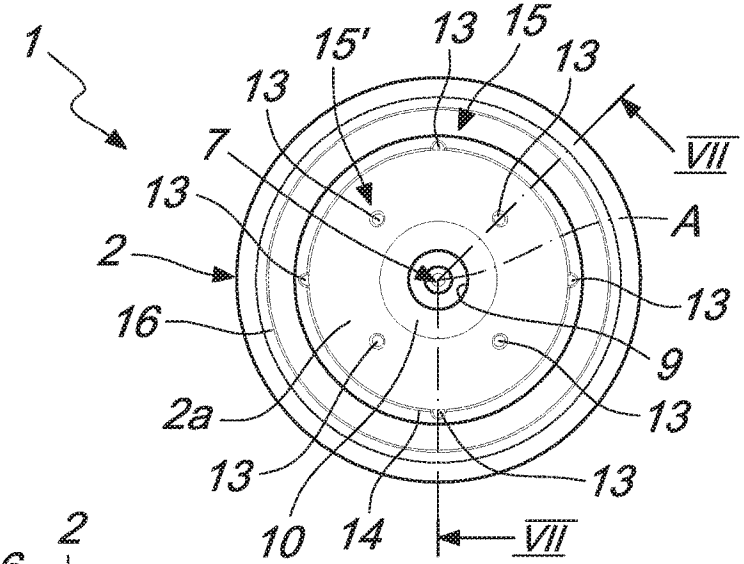
FIG. 6 is a schematic side elevation view of the piston of FIG. 4.
Figure 7:
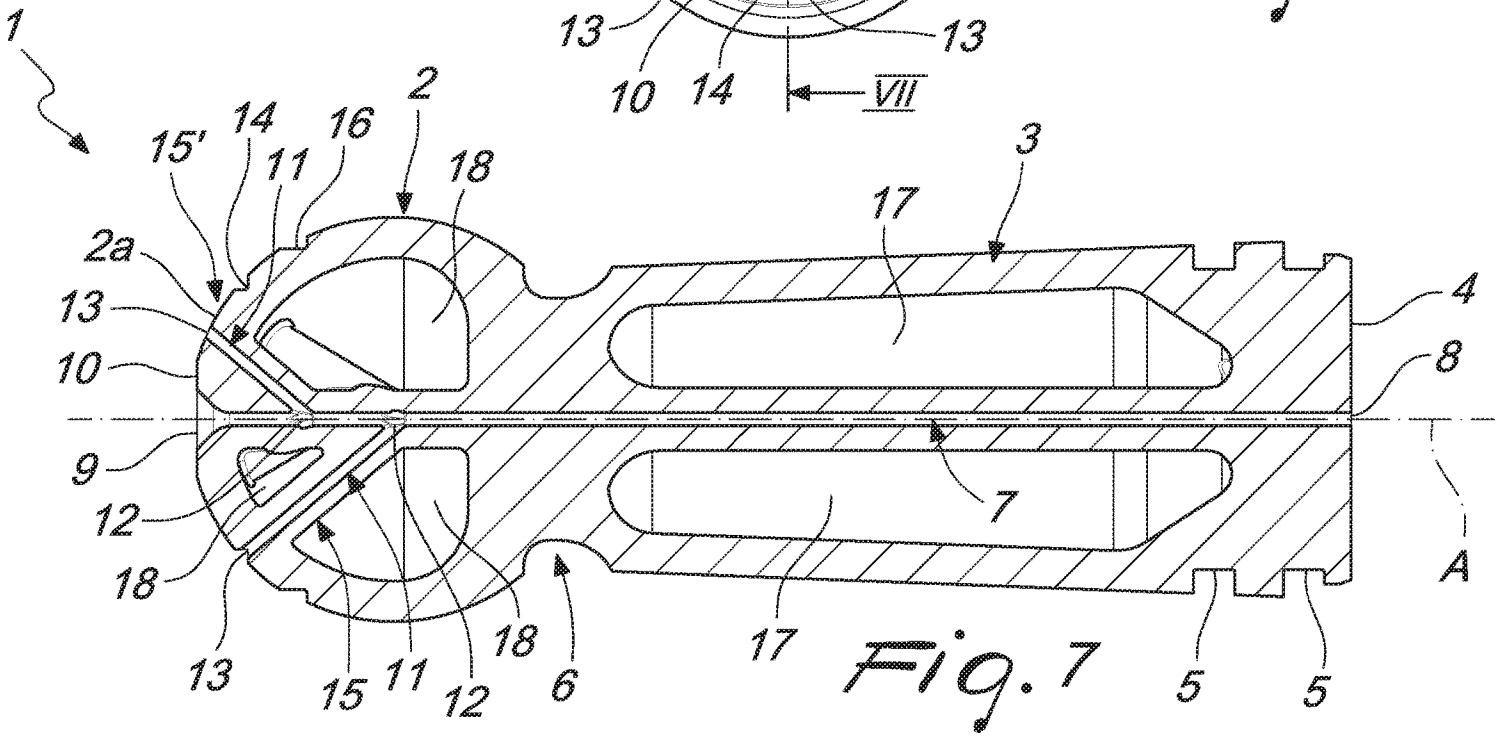
FIG. 7 is a schematic sectional view along the plane VII-VII of FIG. 6.

FIGS. 1-3 represent a first embodiment of the piston 1 particularly suitable for use in a hydraulic machine of the swash-plate type (pump or motor).

In these swash-plate type machines, the seat of the head 2 is generally produced in a bronze sliding block associated with the drive shaft, so that there is less need for lubrication in the coupling area between the head 2 and the relative seat, in view of the limited phenomena of friction that develop in the contact between the different materials with which these components are made.

In this case, the piston 1 comprises a substantially cylindrical stem 3 provided with an annular cavity 17 which extends for the whole of its longitudinal extension. The stem 3 is not provided with annular seats 5 for sealing rings.

The piston 1 is provided with a group 15 comprising four distribution ducts 11 distributed with angular pitch of 90° around the longitudinal axis A.

The head 2 is provided with an annular cavity 18 through which the distribution ducts 11 and the end portion of the intake duct 7 extend.

The head 2 is not provided with a flat region 10, groove 14 and notch 16.

FIGS. 4-7 represent a second embodiment of the piston 1 particularly suitable for use in a hydraulic machine of the bent-axis type (pump or motor).

In these machines of the bent-axis type, the seat of the head 2 is generally obtained directly in the drive shaft, so that there is a greater need for lubrication in the coupling areas between the head 2 and the relative seat in view of the non-negligible phenomena of friction that develop in contact between the metal materials with which these components are made.

In this case the piston 1 comprises a substantially conical stem 3 provided with an annular cavity 17 which extends longitudinally, and with two annular seats 5 for sealing rings.

The piston 1 is provided with two groups 15 and 15' of distribution ducts 11 having their corresponding second ends 13 distributed along a respective circumference centred on the longitudinal axis A. Each group 15, 15' comprises four distribution ducts 11 distributed with angular pitch of 90° around the longitudinal axis A along the respective circumference.

The second ends 13 of the distribution ducts 11 of the two groups 15 and 15' are arranged longitudinally and angularly offset with respect to the longitudinal axis A (FIG. 6) to optimize the distribution of hydraulic oil on the entire spherical cap 2*a* of the head 2.

The second ends 13 of the distribution ducts 11 of the group 15' are interposed axially between the second ends 13 of the distribution ducts 11 of the group 15 and the second end 9 of the intake duct 7.

The first ends 12 of the distribution ducts 11 of the group 15' are interposed axially between the first ends 12 of the distribution ducts 11 of the group 15 and the second end 9 of the intake duct 7.

The head 2 is provided with an annular cavity 18 through which the distribution ducts 11 of the groups 15 and 15' and the end segment of the intake duct 7 extend.

An annular groove 14 is provided at the second ends 13 of the distribution ducts 11 of the group 15.

The head 2 is also provided with a collection notch 16.

Figure 8:
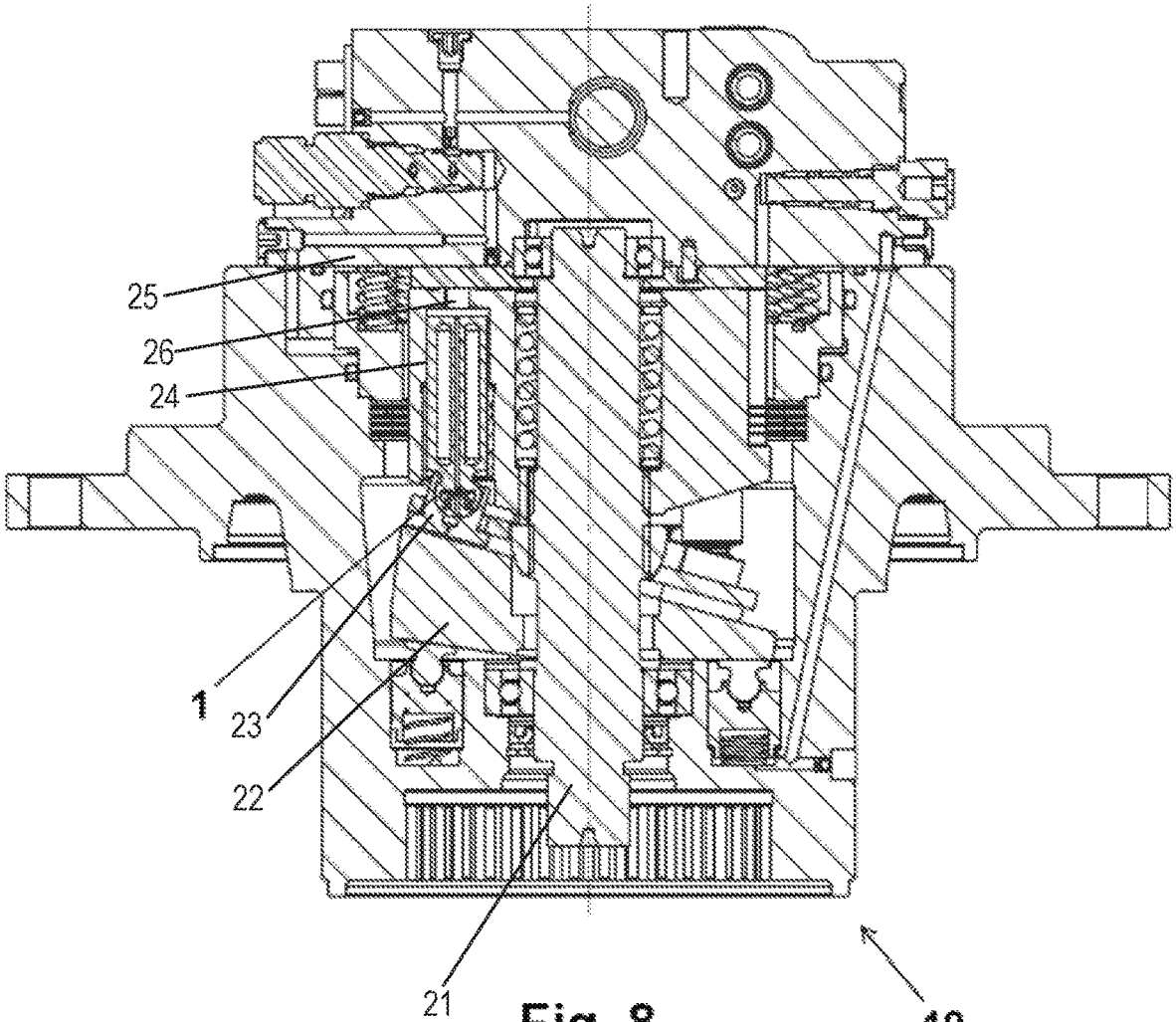
FIG. 8 is a longitudinal sectional view of a hydraulic machine with axial pistons (pump or motor) of a swash-plate type containing the piston of FIGS. 1-3.

FIG. 8 represents a hydraulic machine 19 of the swash-plate type (pump or motor) containing the first embodiment of the piston 1 (FIGS. 1-3) particularly suitable for use in these units.

The hydraulic machine 19 includes a drive shaft 21 and a swash plate 22 coupled to the drive shaft 21. The swash plate 22 includes a plurality of shoes, such as shoe 23, each configured to seat a respective piston head. For example, as shown in FIG. 8, the piston head of the piston 1 is seated in the shoe 23. As explained previously, the shoe 23 may be a broze shoe associated with the drive shaft (e.g., coupled to the drive shaft via the swash plate 22). The piston 1 may be housed in a cylinder 24. The cylinder 24 may be coupled to a distribution plate 25 via a conduit 26. The distribution plate 25 may supply hydraulic fluid (e.g., oil) to the cylinder 24 via the conduit 26 during at least a portion of a rotational cycle of the drive shaft 21. As explained above, oil from the distribution plate may enter the piston 1 via the first end of the adduction duct. The hydraulic machine 19 may include a plurality of pistons similar to piston 1, each housed in a respective cylinder of a cylinder block.

Figure 9:
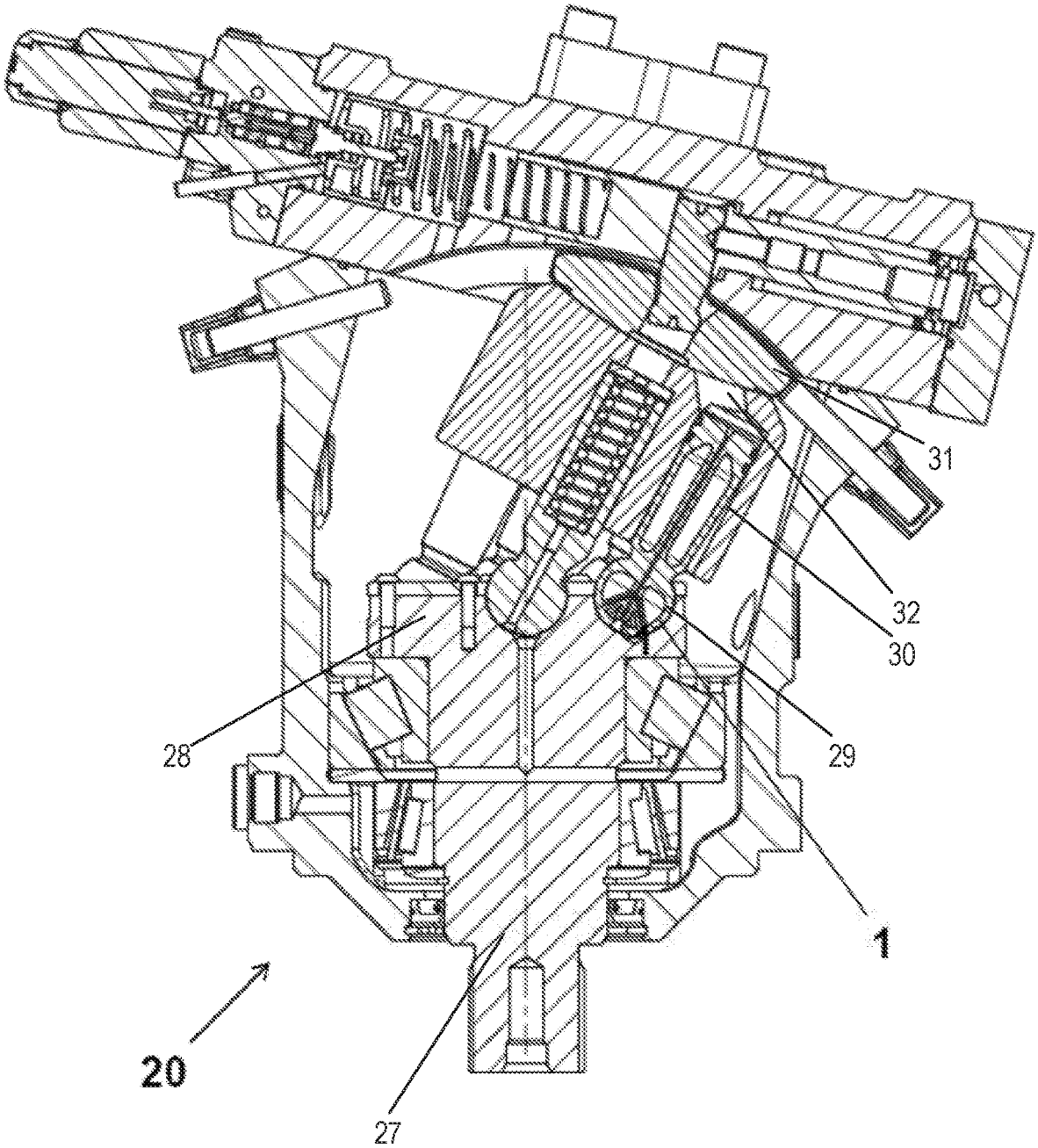
FIG. 9 is a longitudinal sectional view of a hydraulic machine with axial pistons (pump or motor) of a bent-axis type containing the piston of FIGS. 4-7.

FIG. 9 represents a hydraulic machine 20 of the bent-axis type (pump or motor) containing the second embodiment of the piston 1 (FIGS. 4-7) particularly suitable for use in these units.

The hydraulic machine 20 includes a drive shaft 27 and having an abutment plate 28. The abutment plate 28 includes a plurality of receptacles, such as receptacle 29, each configured to seat a respective piston head. For example, as shown in FIG. 9, the piston head of the piston 1 is seated in the receptacle 29. As explained previously, piston head may be seated directly on the motor shaft (e.g., the piston head of piston 1 is directly seated on shaft 27 via receptacle 29 of abutment plate 28). The piston 1 may be housed in a cylinder 30. The cylinder 30 may be coupled to a distribution plate 31 via a conduit 32. The distribution plate 31 may supply hydraulic fluid (e.g., oil) to the cylinder 30 via the conduit 32 during at least a portion of a rotational cycle of the drive shaft 27. As explained above, oil from the distribution plate may enter the piston 1 via the first end of the adduction duct. The hydraulic machine 20 may include a plurality of pistons similar to piston 1, each housed in a respective cylinder of a cylinder block.

It can be seen how the first embodiment of the piston 1 shown in FIGS. 1-3 can also be used in a hydraulic machine of the bent-axis type, such as the one indicated in FIG. 9 and how the second embodiment of the piston 1 shown in FIGS. 4-7 can also be used in a hydraulic machine of the swash-plate type, such as the one indicated in FIG. 8.

In practice, it has been seen how the invention described achieves the objects set forth and in particular it is underscored how the piston according to the invention allows, in use, a hydraulic support of the corresponding head to be obtained for any operating conditions and without involving reductions of the extension of the contact surface between the head and the relative seat which would increase the phenomena of wear and of damage to the components.

Moreover, the piston according to the invention can be easily adapted to the requirements of the specific application, when the type of hydraulic machine in which it is to be incorporated varies, in order to allow optimal operation thereof.

Further, the piston according to the invention can be made with internal lightening cavities in order to improve the performance thereof.

Last but not least, the piston according to the invention can be obtained by known additive manufacturing techniques in order to limit production times and costs.

The invention thus conceived is susceptible to numerous modifications and variants, all falling within the scope of the inventive concept.

Moreover, all details are replaceable with other technically equivalent elements.

In practice, the materials used as well as the contingent shapes and dimensions may be any, according to requirements, without departing from the scope of the appended claims.

FIGS. 1-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention claimed is:

1. A piston for hydraulic machines with axial pistons, comprising a head blended with a stem which is extended along a longitudinal axis and forms a bottom arranged at an opposite end with respect to said head, the bottom comprising a flat surface, at least one intake duct being further provided which passes within said piston and has a first intake end and a second intake end which are mutually opposite and are open respectively at the head and at the flat surface of the bottom, wherein the piston comprises at least one distribution duct which passes within said piston and is provided with a first distribution end and a second distribution end which are mutually opposite, of which the first distribution end is in direct fluid communication with said intake duct and the second distribution end is open at said head, the piston being provided monolithically, and wherein the second intake end is configured to be supplied with a hydraulic fluid from a fluid source.

2. The piston according to claim 1, wherein the piston comprises at least one groove which is formed on an outer surface of said head and is in fluid communication with the second distribution end of said at least one distribution duct.

3. The piston according to claim 2, wherein said at least one groove affects the second distribution end of said at least one distribution duct.

4. The piston according to claim 3, wherein said groove has an annular extension around said longitudinal axis.

5. The piston according to claim 1, wherein the piston comprises a plurality of said distribution ducts each having a respective first distribution end and a respective second distribution end.

6. The piston according to claim 5, wherein said plurality of said distribution ducts comprises at least one group of distribution ducts, the respective second distribution ends of which are distributed along a circumference that is centered on said longitudinal axis.

7. The piston according to claim 6, wherein the second distribution ends of the distribution ducts of said at least one group are distributed with a constant angular pitch around said longitudinal axis.

8. The piston according to claim 7, wherein the distribution ducts of said at least one group have their respective first distribution ends directly in fluid communication with said intake duct.

9. The piston according to claim 1, wherein said head comprises a flat region which is extended around the second intake end of said intake duct.

10. The piston according to claim 1, wherein the piston comprises at least one internal cavity at said head and/or at said stem.

11. The piston according to claim 1, wherein the piston is additive manufactured.

12. The piston according to claim 1, wherein the piston is incorporated in a hydraulic machine with axial pistons of the bend axis type.

13. The piston according to claim 1, wherein the piston is incorporated in a hydraulic machine with axial pistons of the swash-plate type.

14. A piston for hydraulic machines with axial pistons, comprising:

a head blended with a stem which is extended along a longitudinal axis and forms a bottom arranged at an opposite end with respect to said head;

at least one intake duct which passes within said piston and has a first intake end and a second intake end which are mutually opposite and are open respectively at the head and at the bottom;

a plurality of distribution ducts arranged into at least two groups of distribution ducts, wherein each distribution duct passes within said piston and is provided with a respective first distribution end and a respective second distribution end which are mutually opposite, of which each first distribution end is in direct fluid communication with said intake duct and each second distribution end is open at said head, the piston being provided monolithically, wherein the second distribution ends of the distribution ducts of at least one group of the at least two groups are distributed with a constant angular pitch around said longitudinal axis, wherein the corresponding second distribution ends of the at least two groups of distribution ducts are distributed among respective circumferences which are arranged so as to be offset along said longitudinal axis.

15. The piston according to claim 14, wherein the second distribution ends of the distribution ducts of said at least two groups are arranged so as to be angularly offset around said longitudinal axis.

16. A piston for hydraulic machines with axial pistons, comprising a head blended with a stem which is extended along a longitudinal axis and forms a bottom arranged at an opposite end with respect to said head, at least one intake duct being further provided which passes within said piston and has a first intake end and a second intake end which are mutually opposite and are open respectively at the head and at the bottom, wherein the piston comprises a plurality of distribution ducts, wherein each distribution duct passes within said piston and is provided with a respective first distribution end and a respective second distribution end which are mutually opposite, of which each first distribution end is in direct fluid communication with said intake duct and each second distribution end is open at said head, the piston being provided monolithically, wherein the piston comprises an annular collection notch which is formed on an outer surface of said head, the second distribution ends of said distribution ducts being arranged between said notch and the second intake end of said intake duct.

* * * * *